US009518720B2

(12) United States Patent
Kim

(10) Patent No.: US 9,518,720 B2
(45) Date of Patent: Dec. 13, 2016

(54) LED SURFACE LIGHT-EMITTING DEVICE FOR EASY SHIELDING AND MANUFACTURING METHOD THEREOF

(71) Applicant: KMW INC., Hwaseong, Gyeonggi-Do (KR)

(72) Inventor: Duk Yong Kim, Gyeonggi-Do (KR)

(73) Assignee: KMW INC., Hwaseong, Gyeonggi-do (KR)

( * ) Notice: Subject to any disclaimer, the term of this patent is extended or adjusted under 35 U.S.C. 154(b) by 145 days.

(21) Appl. No.: 14/319,651

(22) Filed: Jun. 30, 2014

(65) Prior Publication Data

US 2014/0307437 A1 Oct. 16, 2014

(30) Foreign Application Priority Data

Dec. 30, 2011 (KR) ..... 10-2011-0146916

(51) Int. Cl.
*F21V 15/00* (2015.01)
*F21V 15/01* (2006.01)
(Continued)

(52) U.S. Cl.
CPC ..... *F21V 15/00* (2013.01); *F21K 9/30* (2013.01); *F21K 9/90* (2013.01); *F21V 15/01* (2013.01);
(Continued)

(58) Field of Classification Search
CPC ..... F21K 9/30; F21K 9/90; F21S 8/02; F21V 15/00; F21V 15/01; F21V 15/015
(Continued)

(56) References Cited

U.S. PATENT DOCUMENTS 5,908,234 A * 6/1999 Kreeft ..... F21V 17/164 362/223
8,066,407 B2 11/2011 Remus et al.
2012/0057351 A1* 3/2012 Wilcox ..... F21V 19/0055 362/307
(Continued)

FOREIGN PATENT DOCUMENTS

CN 101975374 A 2/2011
CN 202074332 U 12/2011
(Continued)

OTHER PUBLICATIONS

CN Office Action issued Sep. 28, 2016 in the corresponding Chinese Patent Application No. 201280070917.8.

*Primary Examiner* — Karabi Guharay
(74) *Attorney, Agent, or Firm* — Mintz Levin Cohn Ferris Glovsky and Popeo, P.C.; Kongsik Kim; Colleen H. Witherell

(57) ABSTRACT

The present invention relates to an LED surface light-emitting device for easy shielding, and a manufacturing method thereof, and includes: an integrated type rear-surface case part having an accommodation space portion open toward the front surface portion thereof, wherein a substrate equipped with LEDs is accommodated in the accommodation space portion; a diffusion panel which covers the open front surface portion of the rear-surface case part, and diffuses light of the LEDs to be a surface light source; and a front-surface window frame, the rear surface of which is coupled to the boundary of the front surface portion of the rear-surface case part, with the diffusion panel located on the rear-surface case part. The present invention is configured as a single body without openings to prevent dust and insects from coming therein, and thus can prevent brightness from decreasing according to use.

17 Claims, 9 Drawing Sheets

(51) Int. Cl.
*F21K 99/00* (2016.01)
*F21Y 101/02* (2006.01)
*F21Y 105/00* (2016.01)

(52) U.S. Cl.
CPC ..... *F21Y 2101/02* (2013.01); *F21Y 2105/001* (2013.01); *Y10T 29/49117* (2015.01)

(58) Field of Classification Search
USPC ..... 362/249.02
See application file for complete search history.

(56) References Cited

U.S. PATENT DOCUMENTS

| | | | | |
|---|---|---|---|---|
| 2012/0224372 | A1 | 9/2012 | Ogawa et al. | |
| 2012/0281154 | A1* | 11/2012 | Yokoyama | G02F 1/133611 348/790 |
| 2012/0327638 | A1 | 12/2012 | Tajima et al. | |
| 2013/0094212 | A1* | 4/2013 | Kim | F21V 15/01 362/249.02 |

FOREIGN PATENT DOCUMENTS

| | | | |
|---|---|---|---|
| CN | 202091832 | U | 12/2011 |
| EP | 2 124 255 | A1 | 11/2009 |
| JP | 2002-299700 | A | 10/2002 |
| JP | 2005-327631 | A | 11/2005 |
| JP | 2007-66540 | | 3/2007 |
| JP | 2008-66165 | | 3/2008 |
| JP | 3147577 | U | 10/2008 |
| JP | 2009-16095 | | 1/2009 |
| JP | 2010-3674 | A | 1/2010 |
| JP | 2011-187245 | A | 9/2011 |
| KR | 2009-0028915 | A | 3/2009 |
| KR | 2009-0084064 | A | 8/2009 |
| KR | 10-0924095 | B1 | 11/2009 |
| KR | 2010-0127392 | A | 12/2010 |
| KR | 2011-0022450 | A | 3/2011 |
| KR | 10-1069726 | B1 | 10/2011 |
| WO | WO-2010/039601 | A2 | 4/2010 |

* cited by examiner

LED SURFACE LIGHT-EMITTING DEVICE FOR EASY SHIELDING AND MANUFACTURING METHOD THEREOF

CROSS-REFERENCE TO RELATED APPLICATIONS

This application is a continuation of International Application No. PCT/KR2012/011493 filed on Dec. 26, 2012, which claims a priority to Korean Application No. 10-2011-0146916 filed on Dec. 30, 2011, which applications are incorporated herein by reference.

TECHNICAL FIELD

The present invention relates to an LED surface light-emitting device for easy shielding and a method of manufacturing the same, and more particularly to an LED surface light-emitting device for easy shielding installed on a ceiling of an interior of a building to prevent introduction of foreign substances such as dust or insects and a method of manufacturing the same.

BACKGROUND ART

In recent years, development of lighting devices using an LED as a light source has been accelerated, considering that existing lighting devices consume much electric power and should be frequently replaced due to a short life span thereof.

Currently, lighting devices using an LED as a light source are replacing existing fluorescent lights or light bulbs. The lighting devices are installed on a ceiling of an interior of a building and illuminate a relatively wide area.

However, the lighting devices using surface light emission as lighting devices using LEDs according to the related art have different intensities of illumination at central portions and peripheral portions thereof.

This is because the light of LEDs disposed at the central portions can be emitted to the light dispersing plate on the front side, but the light of LEDs located at the peripheral portions cannot be directly input to the light dispersing plate as it is reflected by a frame on a lateral side of the LEDs.

Further, the surface light-emitting devices using LEDs according to the related art accommodate a substrate to which LEDs are mounted, and a window frame formed of a metal is used as a frame fixed to a ceiling. Then, since the window frame should be formed by separately manufacturing edge frames and be assembled, productivity is very low.

There are very many examples of surface light-emitting devices forming a window frame by assembling divided linear frames, and one of the examples is Korean Patent No. 10-0976274.

It is disclosed in Korean Patent No. 10-0976274 that a first main frame and a second main frame are coupled to each other using bolts to manufacture a main frame, that is, a window frame, and in surface light-emitting devices using LEDs according to the related art, and metallic linear frames are coupled to each other by bolts to manufacture a window frame providing a space for accommodating a substrate to which LEDs are mounted.

A gap is generated between the first main frame and the second main frame, and dust may be introduced through the gap or insects such as mayflies may enter the window frame.

The foreign substances such as dust and insects gather on an upper surface of a light dispersing plate, that is, on an inside of the lighting device, and accordingly, the brightness of the lighting device becomes gradually darker.

This problem can be solved by disassembling the lighting device and cleaning the light dispersing plate, but because the light dispersing plate is inserted into and fixed to a central portion of a window frame when being assembled in the main frame, that is, the window frame, it actually cannot be disassembled.

Accordingly, even when the life span of the LEDs is 10 years or more, the brightness of the lighting device is gradually reduced through introduction of foreign substances, making it difficult to use the lighting device for a long time.

As described above, because the main frame is assembled according to the related art, much time is spent in the assembly process and productivity is low. In particular, because the price of the lighting device is expensive due to use of a metal, an electric light rate reduction effect due to use of LEDs and a lamp exchange cost reduction effect are substantially low, making it difficult to commercialize the device.

In addition, because a metallic frame is used, weight is heavy, and when the LED surface light-emitting device installed on a ceiling falls due to a natural disaster such as an earthquake or a shoddy and faulty construction, it may be very dangerous. Further, because the main frame is fixed to a board installation frame of the ceiling using bolts and is fixed using a wire when being installed on the ceiling to prevent falling of the main frame, construction time is very long.

SUMMARY

Therefore, the present invention has been made in an effort to solve the above-mentioned problems, and the present invention provides an LED surface light-emitting device through which introduction of foreign substance can be prevented and a method of manufacturing the same.

The present invention also provides an LED surface light-emitting device through which an assembly process is simplified to improve productivity and a method of manufacturing the same.

The present invention also provides an LED surface light-emitting device in which a frame and a substrate support panel are formed of a synthetic resin through injection-molding and which can be commercialized earlier by maximizing an energy saving effect expected when an LED illumination is used and a lamp exchange cost saving effect by lowering the price of the product and a method of manufacturing the same.

The present invention also provides an LED surface light-emitting device through which a brightness difference between a central portion and a peripheral portion thereof can be solved and a method of manufacturing the same.

The present invention also provides an LED surface light-emitting device for easy shielding which can be easily constructed and has a light weight such that a degree of risk can be reduced even when it falls from the ceiling and a method of manufacturing the same.

In accordance with an aspect of the present invention, there is provided an LED surface light-emitting device for easy shielding, including: an integral rear case in which a substrate to which LEDs are mounted is accommodated in an accommodation space opened to a front side; a light dispersing panel covering the opened front side of the rear case, for dispersing light of the LEDs to form a surface light source; and an integral front window frame of which a rear surface is coupled to a periphery of a front surface of the rear case while the light dispersing panel is located on the rear case.

In accordance with an aspect of the present invention, there is provided A method of manufacturing an LED surface light-emitting device for easy shielding, the method including: a) manufacturing an integral rear case formed of a synthetic resin through injection-molding to have a bending surface provided on one side of a bottom surface thereof and a support surface flatly extending from the bending surface to a side surface such that an accommodation space having an opened front side is formed, in which a plurality of reinforcing portions and a plurality of coupling supports are located on a rear surface thereof; b) manufacturing a front window frame formed of a synthetic resin through injection-molding to have an opening at a central portion thereof and integrally provided with a plurality of reinforcing portions on a rear surface thereof, the size of the front window frame being larger than the size of the rear case; c) preparing a light dispersing panel for dispersing light such that light is emitted from a surface thereof; d) fixing a substrate to which LEDs are mounted at a predetermined interval within the accommodation space of the rear case; e) stacking the light dispersing panel and the front window frame on the support surface of the rear case in which the substrate is accommodated, and fixing the rear case and the front window frame using a plurality of bolts while the light dispersing panel is interposed between the rear case and the front window frame; and f) locating the power supply unit on the reinforcing portions provided on the rear surface of the rear case and the coupling support, and fixing the power supply to the coupling support using bolts.

According to the present invention, because an LED surface light-emitting device is constituted by coupling a single body having no gap, introduction of dust or insects can be prevented and reduction of brightness due to use thereof can be prevented.

Further, because the present invention does not require an assembly process as the window frame is integrally manufactured and does not require a process of processing a metal, the process can be very simplified and productivity can be improved.

In addition, the frame and the substrate support panel are formed of a synthetic resin through injection-molding, it can be commercialized earlier by maximizing an energy saving effect expected when an LED illumination is used and a lamp exchange cost saving effect by lowering the price of the product Furthermore, because a peripheral portion of the substrate support panel supporting the substrate is processed to be a curved surface or an inclined surface such that light emitted from LEDs located at a periphery of the LEDs can be smoothly provided to the light dispersing plate, a brightness difference between a central portion and a peripheral portion of the surface light-emitting device can be solved.

In addition, a danger can be reduced by reducing weight during falling and the device can be easily constructed by a simple operation. In particular, a process of fixing the device with a wire can be omitted to reduce construction time.

DETAILED DESCRIPTION

Hereinafter, an LED surface light-emitting device for easy shielding and a method of manufacturing the same according to exemplary embodiments of the present invention will be described with reference to the accompanying drawings.

Figure 1:
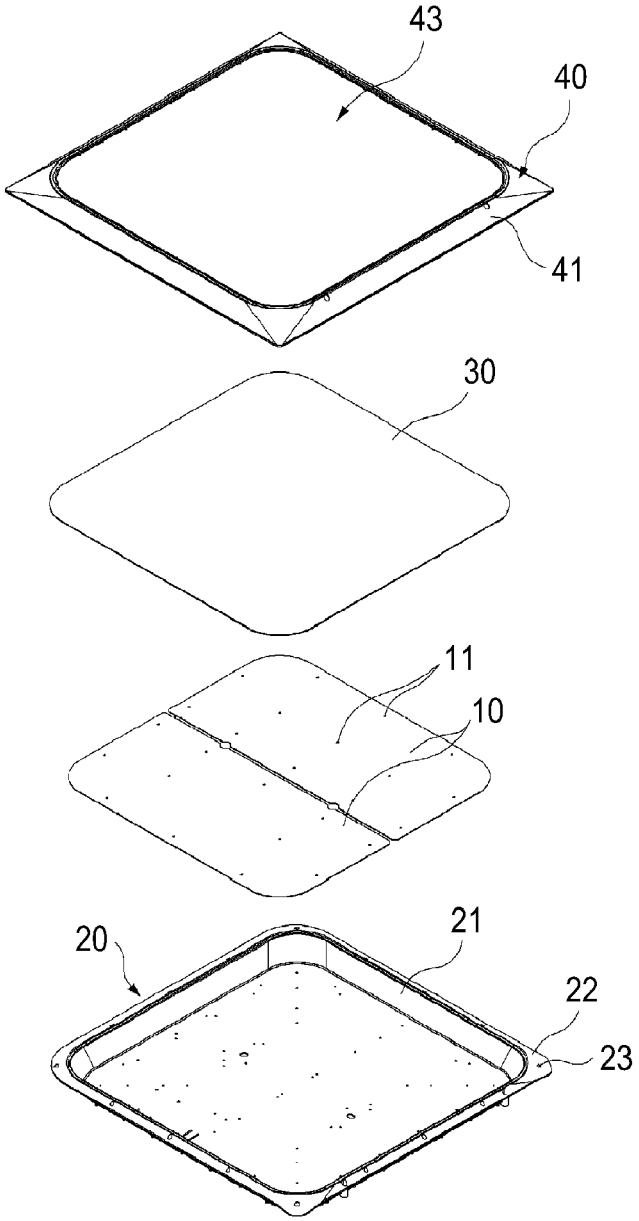
FIG. 1 is an exploded perspective view of an LED surface light-emitting device for easy shielding according to an embodiment of the present invention.
Figure 2:
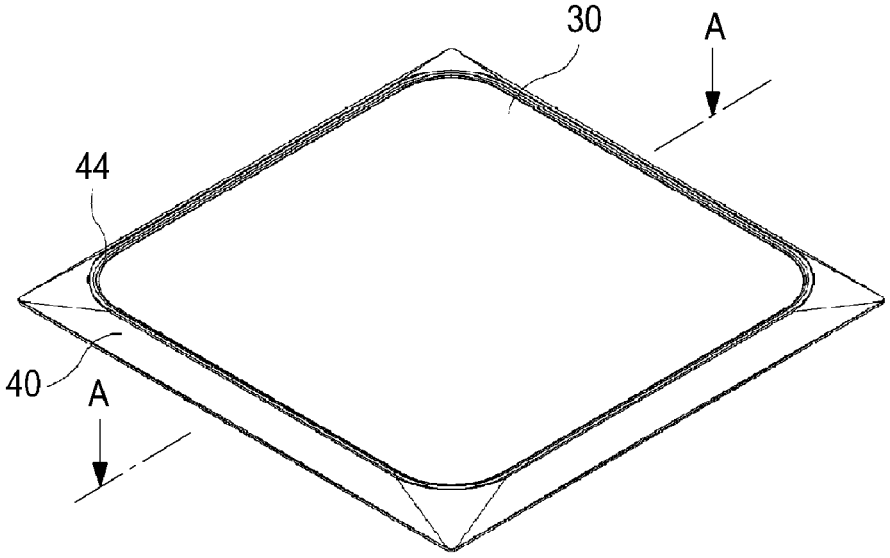
FIG. 2 is a view showing a coupled state of FIG. 1.
Figure 3:
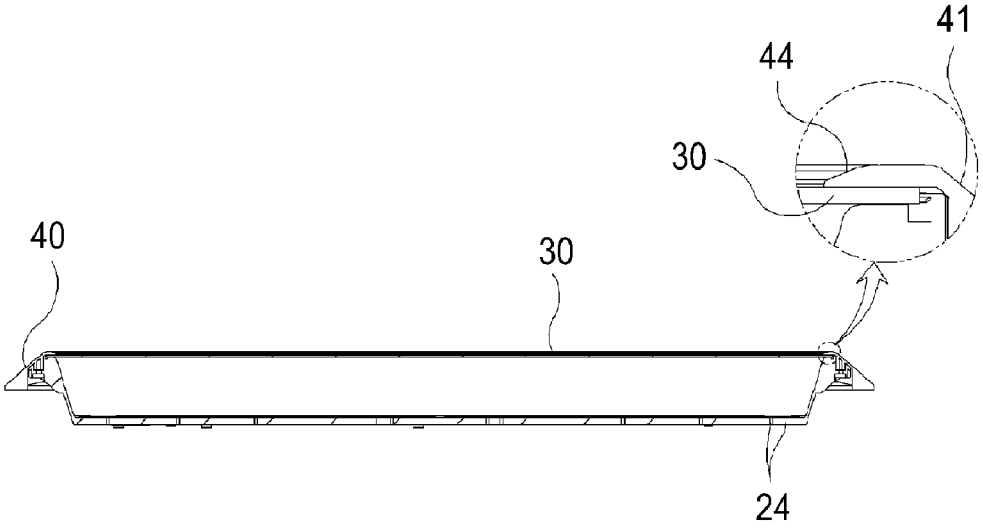
FIG. 3 is a sectional view taken along line A-A of FIG. 2.
Figure 4:
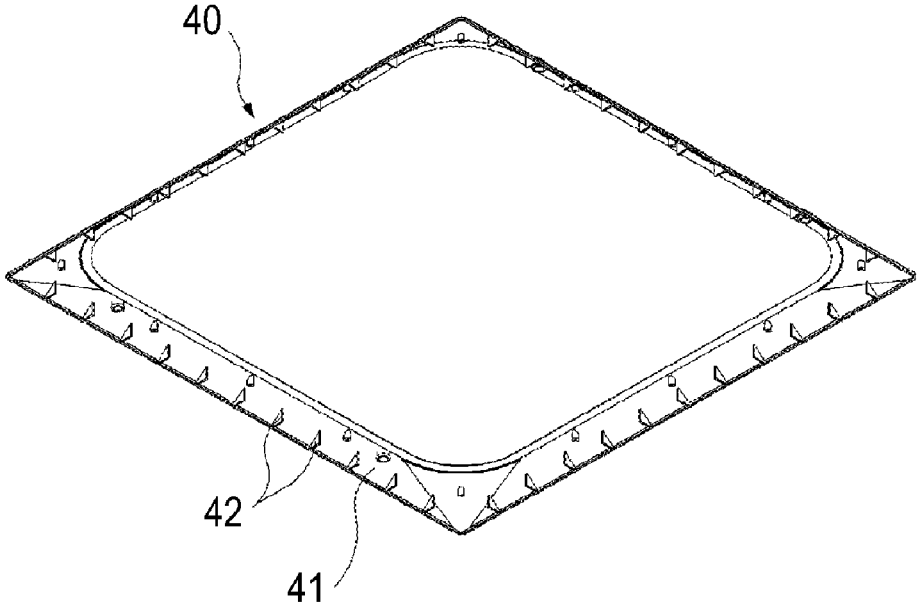
FIG. 4 is a perspective view showing a rear surface of a front window frame of FIG. 1.

FIG. 1 is an exploded perspective view of an LED surface light-emitting device for easy shielding according to an embodiment of the present invention. FIG. 2 is a view showing a coupled state of FIG. 1. FIG. 3 is a sectional view taken along line A-A of FIG. 2. FIG. 4 is a perspective view showing a rear surface of a front window frame 40 of FIG. 1.

Referring to FIGS. 1 to 4, an LED surface light-emitting device for easy shielding according to an embodiment of the present invention includes an integral rear case 20 of which one surface is opened, for providing an accommodation space accommodating a substrate 10 to which an LED is mounted, a light dispersing panel 30 covering the rear case 20 such that a periphery of one surface of the light dispersing panel 30 is located at a periphery of an opened surface of the rear case 20, and a front window frame 40 covering an upper side of the light dispersing panel 30 to be coupled to the rear case 20, for sealing the rear case 20.

Hereinafter, a configuration and an operation of the embodiment of the present invention will be described in more detail.

First, a shape of the rear case 20 has a bending surface 21 formed by bending a periphery of the rear case 20 upwards such that a concave accommodation space is provided on an inside of the bending surface 21. Then, the upwardly bent bending surface 21 of the rear case 20 is bent from a bottom surface of the accommodation space to be inclined at an angle other than the right angle, and light of some of a plurality of LEDs 11 mounted to the substrate 10, which are located at the periphery of the substrate 10, is directly emitted to the light dispersing panel 30 due to the inclination.

Accordingly, a surface light-emitting device in which a difference of brightness of the center and brightness of a periphery thereof are not generated can be realized.

A flat support surface 22 is formed at an upper portion of the bending surface 21 of the rear case 20 in parallel to the bottom surface of the accommodation space to contact the bottom surface of the front window frame 40 and a plurality of coupling holes 23 are provided in the support surface 22 such that the front window frame 40 is bolt-coupled to the rear case 20 while an upper portion of the rear case 20 is covered by the light dispersing panel 30 and the front window frame 40.

A plurality of reinforcing portions 24 may protrude from a rear surface of the rear case 20 to realize a light and firm structure. As will be described below in detail, the reinforcing portions 24 increase areas of the rear case 20 contacting air, and dissipate heat generated in a power supply unit more easily.

A characteristic configuration of the rear case 20 is that the bottom surface of the accommodation space, the bending surface 21, and the support surface 22 are all integrally formed so that introduction of foreign substances can be prevented.

The rear case 20 may be manufactured of a metal, and preferably, may be easily manufactured by injection-molding a synthetic resin. Manufacturing costs can be lowered by using the synthetic resin, and manufacturing time can be shortened.

In addition, the rear case 20 can be easily installed by reducing the weight thereof, and a degree of risk can be reduced by reducing damage due to falling of a lighting device.

An additive which is advantageous in reflection of light may be added to the synthetic resin rear case 20, but a sufficient reflection effect for light can be obtained simply by manufacturing a glossy white synthetic resin.

The substrate 10 to which a plurality of LEDs 11 are mounted is mounted in the accommodation space of the rear case 20, and is fixed by bolts. Then, as shown in the drawings, the substrate 10 may be divided into two parts to supply electric power to them, respectively, so that electric power can be supplied only to one of them if necessary to further reduce power consumption.

Although it is shown in the drawings that the substrate 10 is divided into two parts, the substrate 10 may not be divided to form one body or may be divided into multiple parts.

The light dispersing panel 30 covers the rear case 20 such that a periphery of the rear surface of the light dispersing panel 30 contacts the support surface 22 of the rear case 20 while the substrate 10 is installed in the rear case 20. Then, a portion of the support surface 22 may be exposed to the outside of the light dispersing panel 30 by making the size of the light dispersing panel 30 smaller than the size of the rear case 20, that is, the size of the periphery of the support surface 22.

This structure allows a periphery of the rear surface of the front window frame 40 to contact the support frame 22, and contact portions of the support surface 22 and the front window frame 40 are fixed to each other by coupling bolts.

The size of the front window frame 40 is made to be larger than the size of the rear case 20 having the support surface 22 at a periphery thereof such that the support surface 22 is inserted into the rear side of the front window frame 40 to be fixed.

That is, a side surface of the front window frame 40 corresponds to a downward bending surface 41 which is downwardly bent, and the downward bending surface 41 is supported by a plurality of reinforcing portions 42 protruding from the rear surface of the window frame 40. Then, an opening 43 of the front window frame 40 which corresponds to an inside of the reinforcing portions 42 is configured such that the rear case 20 is inserted into the opening 43, and the rear case 20 may be inserted into an area surrounded by the reinforcing portions 42 to adjust the rear case 20 at a correct position without particularly locating the front window frame 40 and the rear case 20 at correct positions to fix them with bolts.

In this way, the reinforcing portions 42 increase a strength of the front window frame 40, and act as a coupling guide for easy coupling of the front window frame 40 as well.

A peripheral portion of the opening 43 of the front window frame 40 corresponds to a curved portion 44 having a predetermined curvature. The curved portion 44 has a visual effect by which an entire structure of the front window frame 40 can be made to be visually thinner and light diffused from the light dispersing panel 30 and emitted to the outside can be reflected from a peripheral area of the opening 42 of the front window frame 40 to prevent shadows.

Accordingly, surface-emitted light having a more uniform brightness can be provided.

The front window frame 40 may be manufactured of a metal, and may be manufactured of a synthetic resin through injection-molding as in the above-described rear case 20. The front window frame 40 also may have the above-described effect of the rear case 20.

Then, the front window frame 40 also has a sufficient reflectivity of light using a glossy white synthetic resin.

The front window frame 40 and the rear case 20 are coupled to each other using a plurality of bolts on the rear side of the support surface 22 while the front window frame 40 is fitted with the rear case 20. Then, the light dispersing panel 30 of which a periphery is located between the front window frame 40 and the rear case 20 is also firmly fixed at the same time.

Because the rear case 20 and the front window frame 40 are integrally formed in this structure, a gap is not generated and accordingly introduction of foreign substances such as dust or insects can be prevented.

If introduction of foreign substance is prevented, an excellent brightness can be continuously maintained without separate management, and accordingly, the LED surface light-emitting device can be continuously used until the LEDs are no longer of use.

Figure 5:
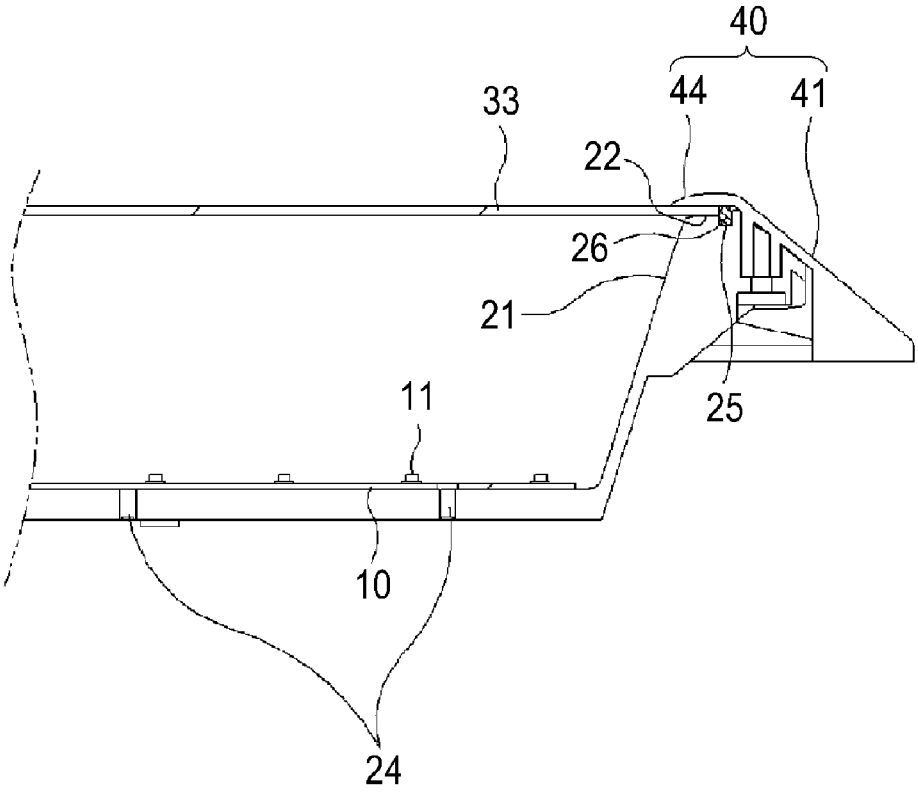
FIG. 5 is a partially sectional view of an LED surface light-emitting device for easy shielding according to another embodiment of the present invention.

FIG. 5 is a partially sectional view of an LED surface light-emitting device for easy shielding according to another embodiment of the present invention.

Referring to FIG. 5, the LED surface light-emitting device for easy shielding according to another embodiment of the present invention has a configuration similar to that of the above-described embodiment of the present invention but further includes an accommodation recess provided along an upper circumference of the support surface 22, and an O-ring 26 may be inserted into the accommodation recess 25 to further prevent generation of a gap between the front window frame 40 and the rear case 20.

Figure 6:
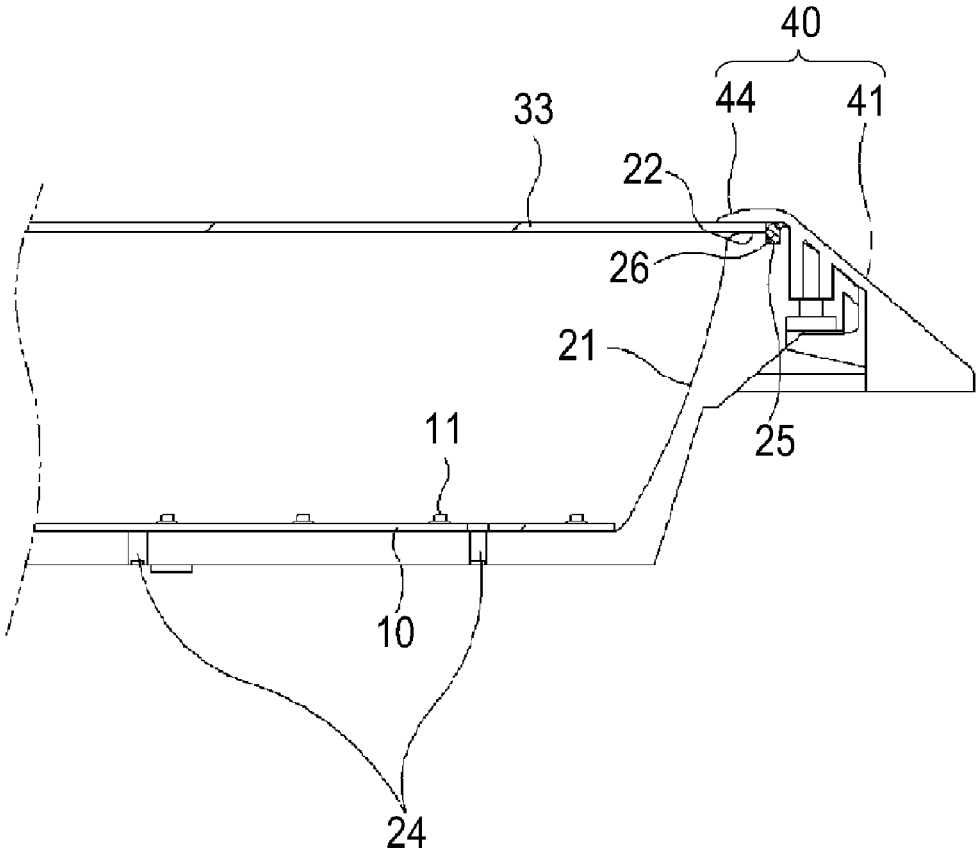
FIG. 6 is a partially sectional view of an LED surface light-emitting device for easy shielding according to another embodiment of the present invention.

FIG. 6 is a partially sectional view of an LED surface light-emitting device for easy shielding according to another embodiment of the present invention.

Referring to FIG. 6, the LED surface light-emitting device for easy shielding according to another embodiment of the present invention may be configured such that the bending surface 21 facing the upper side of the rear case 21 may have a curved shape having a predetermined curvature different from that of the example of FIG. 5.

Then, the curved bending surface 21 minimizes reflection of light emitted from the LEDs 11 at locations adjacent to the curved surface 21 from the curved surface 21, and prevents lowering of the brightness at a peripheral portion of the curved surface by minimizing the reflection angle even if the light is reflected.

Figure 7:
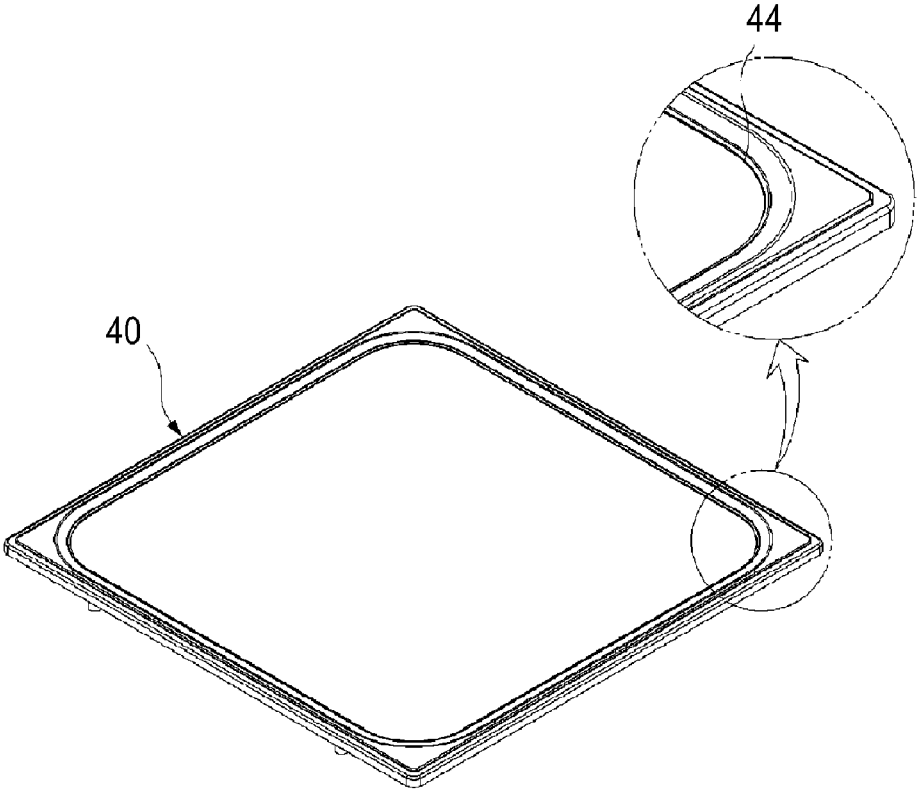
FIG. 7 is a view showing a front window frame of an LED surface light-emitting device according to another embodiment of the present invention.

FIG. 7 is a view showing a front window frame 40 of an LED surface light-emitting device according to another embodiment of the present invention.

Referring to FIG. 7, the front window frame 40 according to another embodiment of the present invention is not provided with the downward curved surface 41 due to the difference from the front window frame 40 according to the above-described embodiments, and accordingly has a flatter structure.

This structure minimizes a degree by which the device according to the present invention protrudes while being installed in a ceiling, and accordingly, the same level of surface as that of a ceiling panel through which the front window frame 40 is installed on the ceiling may be formed.

The front window frame 40 shown in FIG. 7 is also provided with an opening 43, and a curved portion 43 is provided at a periphery of the opening 43 to minimize a brightness difference according to locations and reinforcing portions (not shown) are located on a rear surface of the front window frame 40 at locations corresponding to those of the reinforcing portions 42 of the front window frame 40 to guide a coupling location of the rear case 20.

As can be seen from the above-described embodiments, the LED surface light-emitting device according to the present invention having an excellent sealing property may be manufactured by manufacturing the rear case 20, the light dispersing panel 30, and the front window frame 40, which have integral structures, respectively, first, and coupling the rear case 20, the light dispersing panel, and the front window frame 40 of the integral structures together with the substrate 10.

Because coupling holes for bolts do not need to be processed in the assembly process and the front window frame 40 and the rear case 20 do not need to be manufactured by coupling divided plate structures as well, manufacturing processes thereof can become simple and manufacturing costs can be reduced, which improves productivity.

Figure 8:
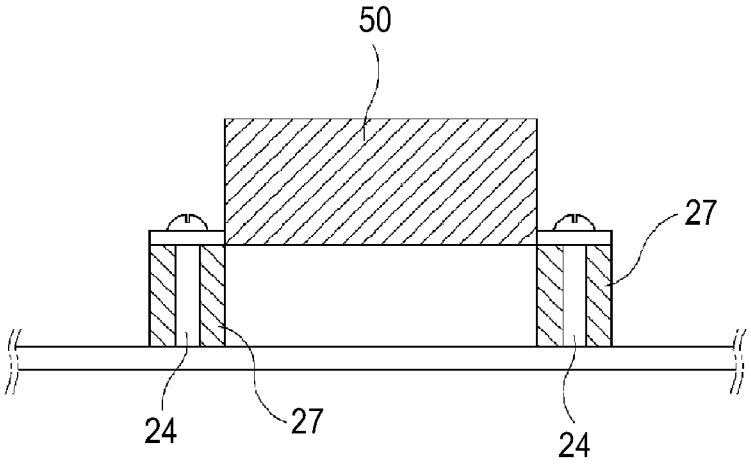
FIG. 8 is a partially sectional view of a rear case in a state in which a power supply unit is installed.

FIG. 8 is a partially sectional view of a rear case unit in a state in which a power supply unit is installed.

Referring to FIG. 8, the present invention has a mounting structure for a power supply unit 50 which may be applied to the above-described embodiments.

A plurality of reinforcing portions 24 are provided on a rear surface of the rear case 20. The reinforcing portions 24 perform a function of increasing strength of the rear case 20 and function to form passages through which air flows.

That is, coupling supports 27 for providing a predetermined coupling area such that the power supply unit 50 is coupled to the coupling supports 27 using bolts are provided at the reinforcing portions 24 at the same height as that of the reinforcing portions 24, portions of the bottom surface of the power supply unit 50 are supported by the coupling supports 27 and the reinforcing portions 24 and the power supply unit 50 is coupled to the coupling supports 27 using bolts.

Then, spaces defined by separations between the reinforcing portions 24 are provided on the lower side of the power supply unit 50, and smooth convection can be made through the spaces such that heat generated by the power supply unit 50 can be emitted.

The easy heat emission of the power supply unit 50 prevents heat generated by the power supply unit 50 from influencing the LEDs 11 and shortening life spans of the LEDs 11 and also prevents a temperature difference between parts of the power supply unit 50 from exceeding a reference value.

The heat emission characteristics of the power supply unit 50 can be improved as the heights of the reinforcing portions 24 and the coupling supports 27 increase, in which case it is preferable to form the reinforcing portions 24 and the coupling supports 27 having suitable heights in consideration of the thickness and heat emission characteristics of the device according to the present invention because the overall thickness of the device increases.

Figure 9:
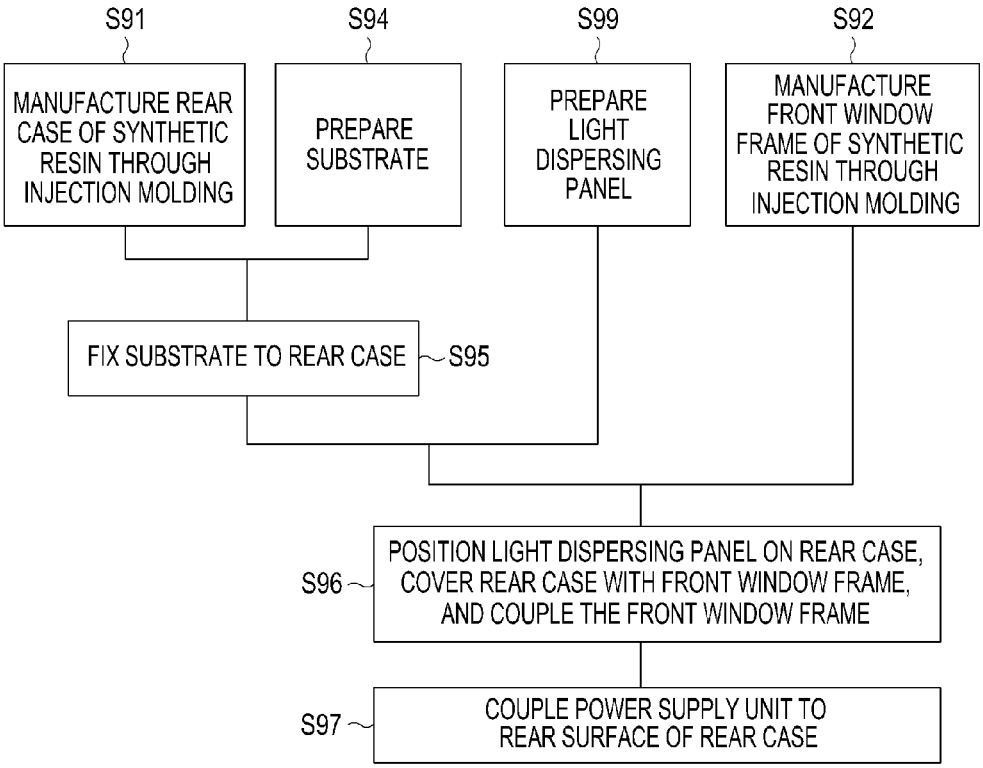
FIG. 9 is a flowchart showing a process of manufacturing an LED surface light-emitting device for easy shielding according to an embodiment of the present invention.

FIG. 9 is a flowchart showing a process of manufacturing an LED surface light-emitting device for easy shielding according to an embodiment of the present invention. The reference numerals of the component elements will coincide with the reference numerals of the drawings which have been described above.

Referring to FIG. 9, a method of manufacturing a surface light-emitting device according to an embodiment of the present invention includes: manufacturing a rear case 20 formed of a synthetic resin through injection-molding to have a bending surface 21 and a support surface 22 such that an opened accommodation space is provided on a front side thereof and in which a plurality of reinforcing portions 24 and a plurality of coupling supports 27 are integrally provided on a rear surface thereof (S91); manufacturing a front window frame 40 formed of a synthetic resin through injection-molding to have a size larger than that of the rear case 20, having an opening 43 at a central portion thereof, and in which a plurality of reinforcing portions 42 are integrally formed on a rear surface thereof (S92), manufacturing a light dispersing panel 30 for diffusing light such that the light is emitted in a surface form (S93); preparing a substrate 10 to which LEDs 11 are mounted at predetermined interval (S94); fixing the substrate 10 within the accommodation space of the rear case 20 (S95); stacking the light dispersing panel 30 and the front window frame 40 on the support surface 22 of the rear case 20 in which the substrate 10 is accommodated, and fixing the rear case 20 and the front window frame 40 using a plurality of bolts while the light dispersing panel 30 is interposed between the rear case 20 and the front window frame 40 (S96); and locating the power supply unit 50 on the reinforcing portions 24 provided on the rear surface of the rear case 20 and the coupling support 27, and fixing the power supply 50 to the coupling support 27 using bolts (S97).

The method of manufacturing an LED surface light-emitting device for easy shielding according to the embodiment of the present invention includes a method of assembling an LED surface light-emitting device for easy shielding, which has been described in the above-described embodiments, and in particular, it is clearly expressed that detailed component elements of the rear case 20 and the front window frame 40 may be manufactured of a synthetic resin as integral bodies.

Hereinafter, the method of manufacturing an LED surface light-emitting device for easy shielding according to the embodiment of the present invention, and an operation and an effect which can be expected by the manufacturing method will be described in more detail.

First, in step S91, a rear case 20 formed of a synthetic resin through injection-molding to have a bending surface 21 and a support surface 22 such that an opened accommodation space is provided on a front side thereof and in which a plurality of reinforcing portions 24 and a plurality of coupling supports 27 are integrally provided on a rear surface thereof is manufactured.

Then, the bending surface 21 is provided to easily separate the rear case 20 from an injection mold and also functions to emit light of a uniform brightness to an entire surface of a light dispersing panel 30 as described above.

It has been described in detail in the above embodiments that the bending surface 21 may have a flat surface or a curved surface.

An additive which may give a glossy white color is added to the synthetic resin, and although the synthetic resin is not particularly limited, a material which is heat-conducive and flexible may contribute to easy coupling afterwards. The flexible synthetic resin may have a problem in strength, but may be reinforced by the reinforcing portions 24.

The curved surface 21, the support surface 22, the reinforcing portions 24, the accommodation recess 25, and the coupling supports 27 are integrally formed in the injection-molded rear case 20, and a post-processing process is not required because the coupling holes 23 are also formed at the same time.

Accordingly, because a separate processing process is not required during the assembly process, which will be described below, processing time can be shortened.

Further, because the rear case 20 is integrally formed without a seam, introduction of foreign substance through a seam can be completely prevented.

If necessary, an O-ring 26 accommodated in the accommodation recess 25 is separately manufactured.

Next, in step S92, a front window frame 40 formed of a synthetic resin through injection-molding to have a size larger than that of the rear case 20 and having an opening 43 at a central portion thereof is manufactured.

The front window frame 40 selectively has a downward bending surface and has reinforcing portions 42 on the rear surface thereof, and the reinforcing portions 42 are also formed integrally.

As described above, a periphery of the opening 43 is provided with a curved surface 44, and a separate processing process is not required because the structures are integrally formed.

Although omitted in the embodiments, coupling holes (not shown) may be formed in the front window frame 40 to pass through the front window frame 40 and the front window frame 40 may be fixed to a metal frame in a ceiling through the coupling holes. According to the present invention, the rear case 20 and the front window frame 40 are manufactured of a synthetic resin through injection-molding, and accordingly, a separate post-processing process is not required and manufacturing costs can be reduced.

Further, safety of the device can be ensured by reducing weight and the device can be easily handled, loaded, and carried.

Next, in step S93, a light dispersing panel 30 for dispersing light and allows emission of light in surface form is prepared. Any light dispersing panel 30 which disperses light of the LEDs 11 in a surface direction of the light dispersing panel 30 if the light is input to one surface of the light dispersing panel 30 to emit light to an opposite surface of the light input surface of the LEDs 11 may be applied irrespective of a material or shape thereof.

Next, in step S94, a substrate 10 to which LEDs are mounted at a predetermined interval is prepared. The substrate 10 may be a single body, or may be several divided parts.

The LEDs 11 mounted to the substrate 10 may be disposed such that the interval between the LEDs 11 is sufficiently long to lower emission of heat and heat generated by the LEDs is minimized by lowering the outputs thereof.

Next, in step S95, the substrate 10 is fixed within the accommodation space of the rear case 20. Then, wires for supplying electric power to the substrate are wired to pass through a rear surface of the rear case 20.

The through-holes for supply of electric power also may be formed during the injection-molding of the rear case 20, and a process of forming the through-hole through which the wires pass in the rear case 20 of a resin is very easy.

Next, in step S96, the light dispersing panel 30 and the front window frame 40 are stacked on the support surface 22 of the rear case 20 in which the substrate 10 is accommodated, and the rear case 20 and the front window frame 40 are fixed using a plurality of bolts while the light dispersing panel 30 is interposed between the rear case 20 and the front window frame 40

Then, the above-described O-ring 26 may be coupled to the accommodation recess 25 of the support surface 22 while the O-ring 26 is accommodated in the recess 25, and accordingly, foreign substances are blocked between the rear case 20 and the front window frame 40 such that introduction of foreign substances therebetween is prevented.

Then, because the coupling holes provided in the rear case 20 are formed at the same time when the rear case 20 is injection-molded, a separate processing process is not required and accordingly coupling time can be shortened.

Next, in step S97, the power supply unit 50 is located on the reinforcing portions 24 provided on the rear surface of the rear case 20 and the coupling support 27, and the power supply 50 is fixed to the coupling support 27 using bolts. According to the manufactured device of the present invention, introduction of foreign substances can be prevented because the foreign substances can be blocked very easily, and It will be appreciated by those skilled in the art to which the present invention pertains that the present invention is not limited to the embodiment and may be variously modified without departing from the spirit of the present invention.

Because the present invention provides an LED surface light-emitting device which is shielded to prevent introduction of dust or insects, a degree of illumination of the device can be prevented from being lowered by the foreign substances, which is industrially applicable.

The invention claimed is:

1. An LED surface light-emitting device for easy shielding, comprising:

an integral rear case (20) in which a substrate (10) to which LEDs (11) are mounted is accommodated in an accommodation space opened to a front side;

a light dispersing panel (30) covering the opened front side of the rear case (20), for dispersing light of the LEDs (11) to form a surface light source;

an integral front window frame (40) of which a rear surface is coupled to a periphery of a front surface of the rear case (20) while the light dispersing panel (30) is located on the rear case (20); and a power supply unit, wherein the rear case (2) includes:

a plurality of reinforcing portions protruded from a rear side of the flat bottom surface to which the substrate (10) is fixed; and coupling supports (27) provided on the rear side of the flat bottom surface to which the substrate (10) is fixed, wherein portions of one surface of the power supply unit (50) is supported by coupling supports (27) and the reinforcing portions (24).

2. The device of claim 1, wherein the rear case (20) and the front window frame (40) are formed of a synthetic resin through injection-molding.

3. The device of claim 1, wherein the rear case (20) and the front window frame (40) are glossy and white-colored.

4. The device of claim 1, wherein the rear case (20) comprises a bending surface (21) bent from a periphery of a flat bottom surface to which the substrate (10) is fixed toward a front side, and a support surface (22) extending from an end of the bending surface (21) to an outside and coupled to the front window frame (40).

5. The device of claim 4, wherein the bending surface (21) is inclined such that it becomes wider as it goes upwards.

6. The device of claim 5, wherein the bending surface (21) is a flat surface or a curved surface.

7. The device of claim 4, wherein an accommodation recess (25) is provided along a circumference of the support surface (22) of the rear case (20), and the device further comprises an O-ring (26) inserted into the accommodation recess (25) to improve a sealing property when being coupled to the front window frame (40).

8. The device of claim wherein heights of the coupling supports (27) and the reinforcing portions (24) are the same.

9. The device of claim 1, wherein a peripheral portion of a central opening (43) of the window frame (40) corresponds to a curved portion (44).

10. The device of claim 9, wherein the window frame (40) corresponds to a downward bending surface (41) inclined downwards as it goes from an opening (43) to an outside.

11. The device of claim 9, wherein a rear surface of the window frame (40) is provided with a plurality of reinforcing portions (42).

12. The device of claim 11, wherein the reinforcing portions (42) are provided at locations spaced apart from a circumference of the opening (43) by a predetermined distance to guide a coupling location of the rear case (20).

13. The device of claim 1, wherein the substrate is divided into two or more parts.

14. A method of manufacturing an LED surface light-emitting device for easy shielding, the method comprising:

a) manufacturing an integral rear case (20) formed of a synthetic resin through injection-molding to have a bending surface (21) provided on one side of a bottom surface thereof and a support surface (22) flatly extending from the bending surface to a side surface such that an accommodation space having an opened front side is formed, in which a plurality of reinforcing portions (24) and a plurality of coupling supports (27) are located on a rear surface thereof;

b) manufacturing a front window frame (40) formed of a synthetic resin through injection-molding to have an opening (43) at a central portion thereof and integrally provided with a plurality of reinforcing portions (42) on a rear surface thereof, the size of the front window frame (40) being larger than the size of the rear case (20);

c) preparing a light dispersing panel (30) for dispersing light such that light is emitted from a surface thereof;

d) fixing a substrate (10) to which LEDs (11) are mounted at a predetermined interval within the accommodation space of the rear case (20);

e) stacking the light dispersing panel (30) and the front window frame (40) on the support surface (22) of the rear case (20) in which the substrate (10) is accommodated, and fixing the rear case (20) and the front window frame (40) using a plurality of bolts while the light dispersing panel (30) is interposed between the rear case 20 and the front window frame (40); and f) locating the power supply unit (50) on the reinforcing portions (24) provided on the rear surface of the rear case (20) and the coupling support (27), and fixing the power supply (50) to the coupling support (27) using bolts.

15. The method of claim 14, wherein in step a), the rear case is injection-molded in a state in which coupling holes (23) are provided at locations thereof where the rear case and the front window frame are coupled to each other using bolts.

16. The method of claim 14, wherein in step a), the support surface of the rear case is integrally injection-molded in a state in which an accommodation recess 25 is formed along a circumference of the accommodation space, and is coupled to the front window frame in step f) while an O-ring (26) is accommodated in the accommodation recess (25).

17. The method of claim 14, wherein in step f), the rear case (20) is coupled to the front window frame (40) such that the reinforcing portions (42) of the front window frame (40) are located outside the rear case (20).

* * * * *